US006669211B2

(12) United States Patent
Gonthier

(10) Patent No.: US 6,669,211 B2
(45) Date of Patent: Dec. 30, 2003

(54) DEVICE FOR RETAINING A BOOT ON A SPORTS APPARATUS

(75) Inventor: Jean-Francois Gonthier, Viuz la Chiesaz (FR)

(73) Assignee: Salomon S.A., Metz-Tessy (FR)

( * ) Notice: Subject to any disclaimer, the term of this patent is extended or adjusted under 35 U.S.C. 154(b) by 44 days.

(21) Appl. No.: 10/053,681

(22) Filed: Jan. 24, 2002

(65) Prior Publication Data

US 2002/0101044 A1 Aug. 1, 2002

(30) Foreign Application Priority Data

Jan. 31, 2001 (FR) ..... 01 01537

(51) Int. Cl.[7] ..... A63C 9/04

(52) U.S. Cl. ..... 280/11.3; 280/611; 280/14.22; 280/14.21

(58) Field of Search ..... 280/11.3, 624, 280/611, 7.12, 7.13, 11.33, 625, 626, 631, 632, 615, 617, 14.21, 14.22; 36/115, 117.2, 117.3, 117.4, 132, 31

(56) References Cited

U.S. PATENT DOCUMENTS 1,187,817 A * 6/1916 Collis ..... 280/11.3
5,852,852 A 12/1998 Rigal ..... 24/68 R
6,076,848 A * 6/2000 Rigal et al. ..... 280/634
6,116,634 A * 9/2000 Mometti ..... 280/613
6,250,651 B1 * 6/2001 Reuss et al. ..... 280/14.21
6,394,484 B1 * 5/2002 Maravetz et al. ..... 280/624
6,520,511 B2 * 2/2003 Gonthier ..... 280/11.36
6,536,138 B1 * 3/2003 Miralles ..... 36/50.1
6,554,297 B2 * 4/2003 Phillips et al. ..... 280/14.22
2002/0101044 A1 * 8/2002 Gonthier ..... 280/11.3

FOREIGN PATENT DOCUMENTS

EP 0812552 12/1997
FR 2774302 8/1999

* cited by examiner

*Primary Examiner*—Brian L. Johnson
*Assistant Examiner*—J. Allen Shriver
(74) *Attorney, Agent, or Firm*—Greenblum & Bernstein, P.L.C.

(57) ABSTRACT

A device for retaining a boot on a sports apparatus. The device includes a strap provided to extend between two fasteners, the strap including a covering portion and one or two fastening portions. A cover covers the covering portion to demarcate a channel for receiving a free end of each fastening portion.

21 Claims, 3 Drawing Sheets

1

91
85
90
21
84
81
80
12
13
83
6
82
2
7
3

DEVICE FOR RETAINING A BOOT ON A SPORTS APPARATUS

CROSS-REFERENCE TO RELATED APPLICATION

This application is based upon French Patent Application No. 01 01537, filed on Jan. 31, 2001, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a device for retaining a boot on a sports apparatus, in which the boot is retained by means of at least one strap, 2. Description of Background and Relevant Information Devices of the aforementioned type are used for snowboarding, snow skiing, waterskiing, snowshoeing, roller skating, and the like.

A strap device according to the prior art includes at least one strap that extends transversely between a fist fastener and a second fastener.

The strap generally has three successive portions that include a first fastening portion, a portion for covering the foot or the boot, and a second fastening portion. The portions are linked to one another by connecting means, such that the fastening portions are each partially above the covering portion. The length of the strap is adjusted by varying the superimposition length.

Generally, at least one free end of the fastening portion projects in relation to the covering portion which is in contact with the boot. This projection of one or both free ends of the fastening portions can hinder the operation of the apparatus.

In snowboarding, for example, when a user has only one foot retained on the board, and he/she pushes alternatively with the other foot, a free end of a strap portion can hinder the movement of the other foot.

One free end of a strap portion can also hinder the movement of a hand above the device. This is particularly the case when the user performs style figures or maneuvers that require holding an edge of the board with one hand.

In roller skating, skiing, or snowshoeing, the projection of an end of a strap portion can hinder a relative movement of one leg in relation to the other. An apparatus retained to one leg can hook an end of a strap portion of a device connected to the other leg.

SUMMARY OF THE INVENTION

An object of the invention in particular is to reduce or eliminate the hindrance caused by the projection, of a free end of a fastening portion of the strap, in relation to the covering portion.

To this end, the invention proposes a device for retaining a boot on a sports apparatus, the device including at least one strap provided to retain the boot on the apparatus, the strap extending transversely between a first fastener and a second fastener of the device, the strap including a portion for covering the boot, and one or two fastening portions, a connection connecting each fastening portion to the covering portion, a free end of the fastening portion being above the covering portion.

According to the invention, a cover covers the covering portion to demarcate a channel for receiving the free end of each fastening portion, the cover extending from a connection up to a fastener, or from one of the connections to the other.

Each free end of a fastening portion is housed in the channel, which avoids the projection in relation to the covering portion. As a result, no obstacle hinders the passage right above the strap.

As a result, advantageously, the user has less or no difficulty in passing a foot or a hand in the vicinity of a strap of the device.

BRIEF DESCRIPTION OF DRAWING

Other characteristics and advantages of the invention will be better understood from the description that follows, with reference to the annexed drawings showing, by way of a non-limiting example, how the invention can be embodied, and in which.

DETAILED DESCRIPTION OF THE INVENTION

An embodiment of the invention is described hereinafter with reference to FIGS. 1–4.

Figure 1:
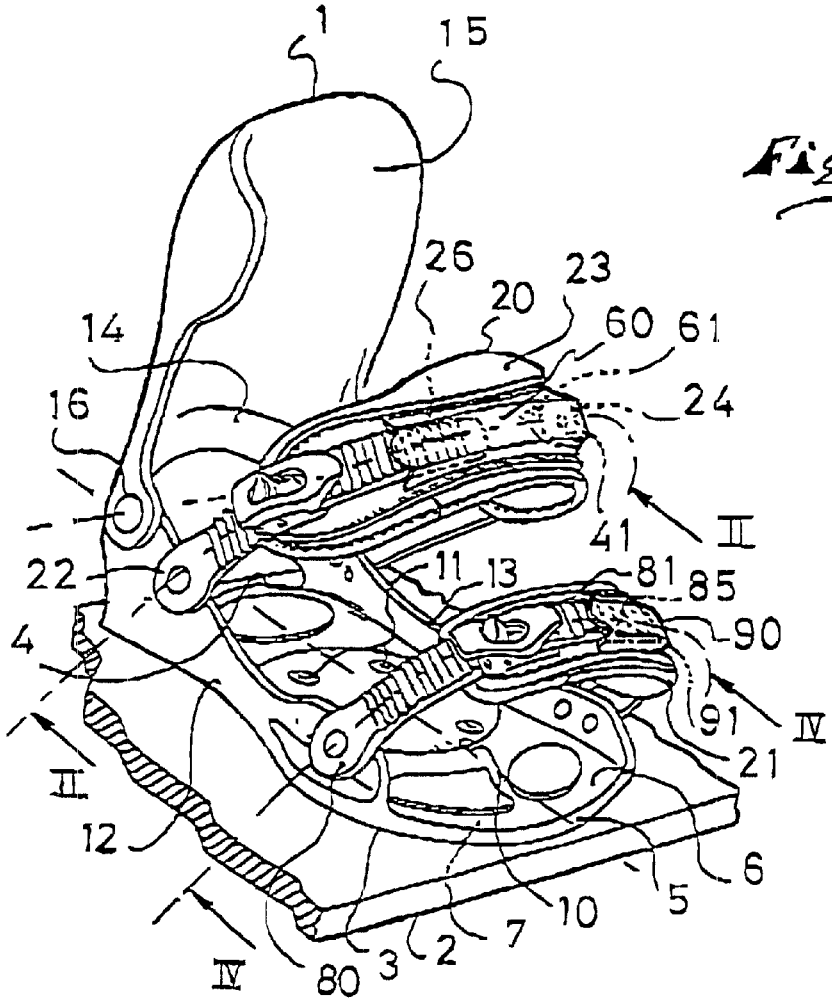
FIG. 1 is a perspective view of the device for retaining a boot on a snowboard according to the invention.

As seen in FIG. 1, a retaining device 1 enables a boot (not shown) to be detachably retained on a board 2, In known fashion, the retaining device 1 includes a base 3 that extends longitudinally between a rear end 4 and a front end 5.

The base 3 has an upper surface 6 provided to face the sole of the boot, and a lower surface 7 provided to be above the board 2.

The base 3 is retained on the board 2 by a structure shown in the form of a disk 10, itself retained to the board 2 by screws 11.

It is contemplated, according to the invention, that other means for retaining the base 3 could be provided.

The base 3 is edged laterally with a first flange 12 and a second flange 13. When the boot is in place on the device 1, the flanges 12, 13 extend laterally along the sole. The flanges 12, 13 are connected by an arch 14 in the area of the rear end 4.

Preferably, the base 3, ranges 12, 13 and arch 14 form a single piece, i.e., they are unitary, and are made, for example, of a synthetic material. However, it could be provided that the flanges or the arch be pieces affixed to the base by any other means, such as gluing, welding, screws, nesting, or the like.

A rear support element 15 enables the user to take rear supports with the lower leg. The rear support element 15 is affixed to the flanges 12, 13, for example, by means of a journal 16.

Two straps are also provided for detachably retaining the boot on the base 3, between the flanges 12, 13.

A first strap 20 is located toward the rear, in the area of the instep when the foot is retained. A second strap 21 is located toward the front, in the area of the metatarsophalangeal joint when the foot is retained.

It is also contemplated, within the scope of the invention, that a different number of straps could be provided.

Figure 2:
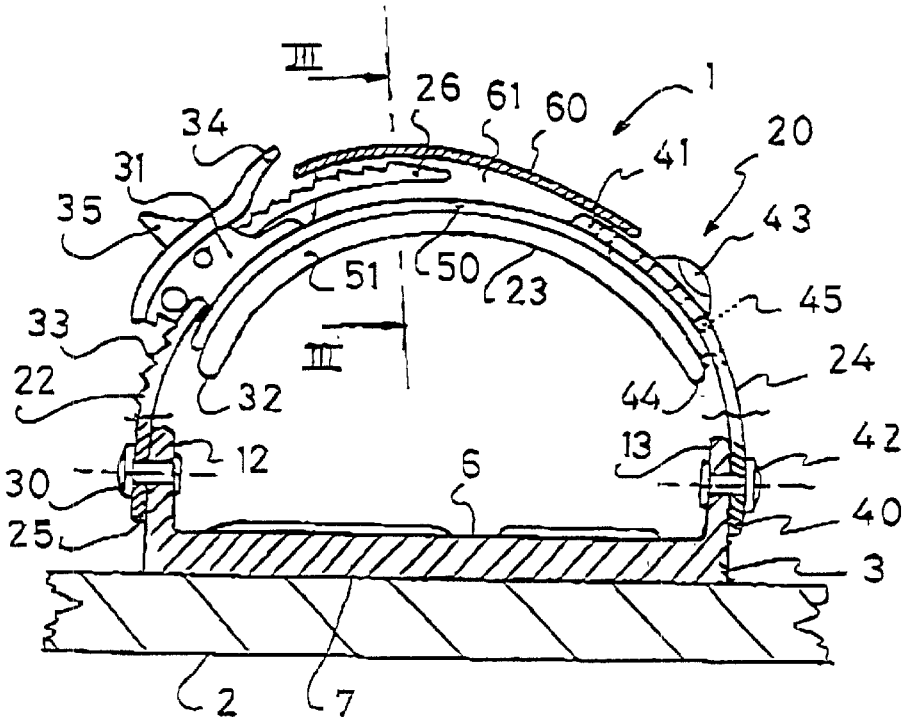
FIG. 2 is a cross-section along the line II—II of FIG. 1.

As seen clearly in FIG. 2, the rear strap 20 extends transversely between the first flange 12 and second flange 13.

The rear strap 20 is shown in the form of a succession of three portions, which include a first fastening portion 22, a portion 23 for covering the boot, and a second fastening portion 24.

The first portion 22 has a fastening end 25 and a free end 26. The fastening end 25 is connected to the first flange 12 by a first fastener. The latter is shown in the form of a journal taking the form of a rivet 30, for example.

A first connection is provided for detachably connecting the covering portion 23 to the first portion 22, the free end 26 of the first fastening portion 22 being above the covering portion 23. This connection includes, for example, a ratchet tightening mechanism 31 fixed to the covering portion 23, in the area of a first end 32 of the latter. The connection for connecting the covering portion 23 to the first portion 22 also includes a series of teeth 33 configured on the first portion 22. The teeth 33 are distributed from the free end 26 up to the vicinity of the journal 30.

By actuating a lever 34 of the mechanism 31, it is possible to tighten the strap 20 by bringing the first end 32 toward the first flange 12. Thus, the tightening mechanism 31 can be brought to a lowermost position in tightening the strap upon the boot. By actuating a button 35 of the mechanism 31, it is possible to loosen the strap 20, to thereby bring the tightening mechanism to an upper, or loosened position, or even to open the strap relative to the tightening mechanism 35. In this latter case, the covering portion 23 and first portion 22 are separated.

Other means could be provided for connecting the covering portion 23 to the first portion 22, according to the invention.

The second fastening portion 24 has a fastening end 40 and a free end 41. The fastening end 40 is connected to the second flange 13 by a second fastener. The latter is shown in the form of a journal, taking the form of a rivet 42, for example.

A second connection is provided for adjustably connecting the covering portion 23 to the second portion 24, the free end 41 of the second fastening portion 24 being above the covering portion 23. This connection includes, for example, a screw 43 that is screwed in the covering portion 23, in the area of a second end 44 of the latter. The screw 43 extends through one of the holes 45 bored into the second portion 24.

Thus, the user can cause the second end 44 of the covering portion 23 to be in the vicinity of the second flange 13. The positional adjustment of the covering portion 23 in relation to the second portion 24 is rarely modified. It is provided for taking the boot space requirement into account.

The two journals extend substantially along a transverse axis of the device; this enables the strap 20 to uniformly cover the boot.

The journals could be obtained by other means, such as screws, pins, or the like, according to the invention.

Similarly, the fastenings of the strap 20 to the flanges 12, 13 could be carried out by other means, such as winding around a keeper, or the like.

The strap 20 is substantially inextensible lengthwise, i.e., from one flange to the other. The materials of which it is made are selected to this end. In particular, the first and second portions 22, 24 are preferably made in the form of band made out of a synthetic material, such as polyamide or reinforced or non-reinforced polyurethane. The covering portion 23 includes a reinforcement 50 that is both relatively flexible in bending and substantially inextensible longitudinally.

A shock-absorbing pad 51, located beneath the reinforcement 50, can be provided for taking support on the boot.

According to the invention, a cover 60 covers the covering portion 23 to demarcate a channel 61 for receiving the free ends 26, 41 of the fastening portions 22, 24. The cover 60 extends from the first connection up to the second connection, i.e., from the tightening mechanism 31 up to the screw 43. The connections themselves are not housed in the channel 61.

The free end 26 of the first fastening portion 22 is housed in the channel 61 as soon as it comes out of the mechanism 31. By analogy, the free end 41 of the second fastening portion 24 is housed in the channel 61, right after the screw 43.

The cover 60 is seed so that each free end 26, 41 can slide freely in the channel, whether or not being superimposed on the other end.

Figure 3:
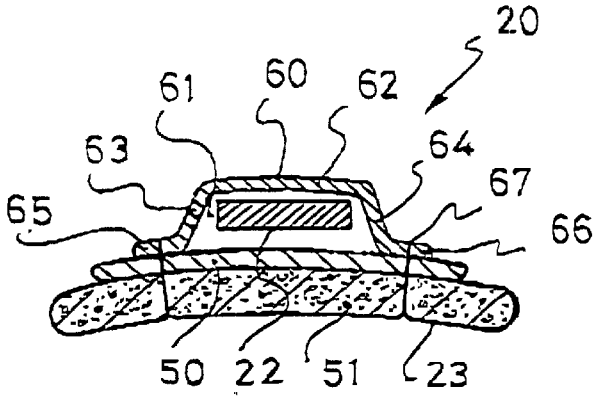
FIG. 3 is a cross-section along the line III—III of FIG. 2.

As seen in FIG. 3, the cover 60 has the general shape of a chute with a bottom 62 substantially parallel to the covering portion 23, and lateral portions 63, 64 for connection to the covering portion. Each of the lateral portions 63, 64 has an incurved end 65, 66 for taking support on the top of the covering portion 23, preferably in the area of the reinforcement 50.

The bottom 62, lateral walls 63, 64 and incurved ends 65, 66 preferably form a single, i.e., unitary, piece made, for example, of a flexible or rigid plastic material.

Alternatively, other materials could be used, such as a metallic alloy or a fiber cloth. Similarly, the cover 60 could be made of a plurality of portions assembled to one another.

The cover 60 is affixed to the covering portion 23 of the first strap 20, for example, by a seam 67. However, other means, such as gluing, are suitable.

By maintaining the free ends 26, 41 in the channel 61, the cover 60 provides the first strap 20 with a reduced vertical space requirement. As a result, the passage of a hand, boot or sports apparatus above the device is done with little or no difficulty.

Figure 4:
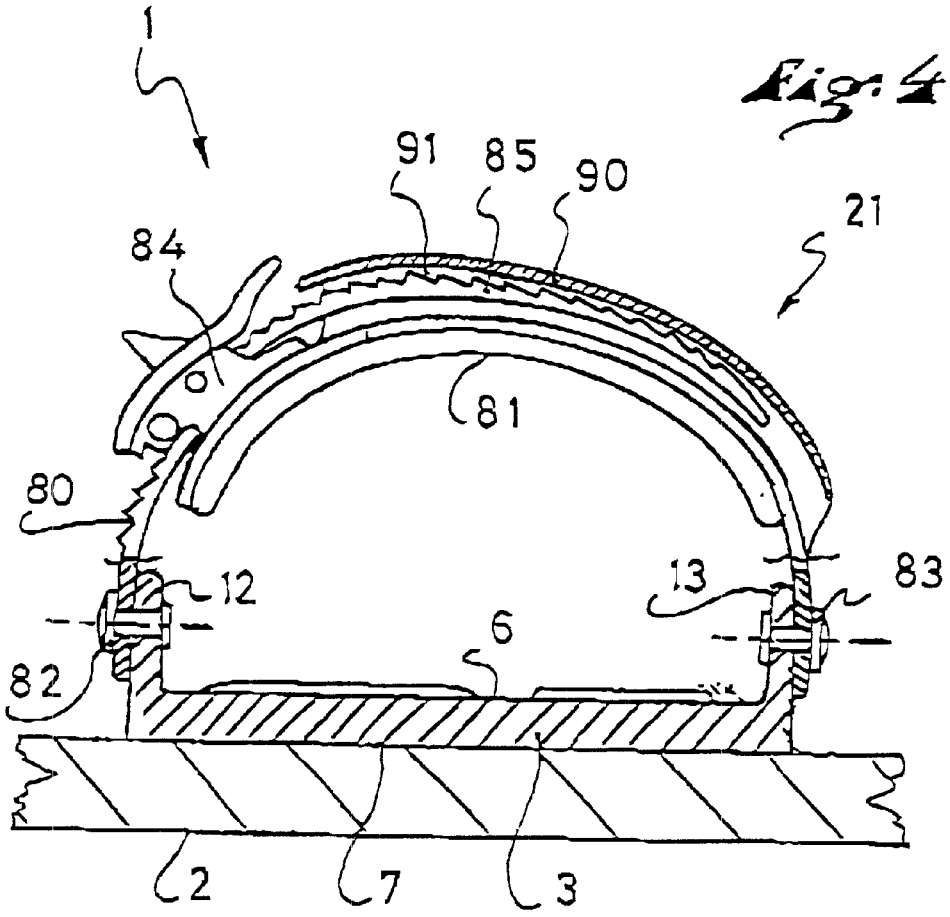
FIG. 4 is a cross-section along the line IV—IV of FIG. 1.

The front strap 21 is described hereinafter with reference to FIG. 4, in a simplified manner, in view of the similarities with the rear strap 20.

As is known, the front strap 21 extends transversely from the first flange 12 to the second flange 13. The strap 21 includes a single fastening portion 80 connected to the first flange 12 by a first fastener, and a portion 81 for covering the boot connected directly to the second flange 13 by a second fastener.

Each of the fasteners is shown in the form of a journal taking the form of rivets 82, 83, for example.

The fastening portion 80 is detachably connected to the covering portion 81 by a connection made, for example, by means of a tightening mechanism 84.

A free end 85 of the fastening portion 80 passes above the covering portion 81, upon exit from the mechanism 84.

According to the invention, a cover 90 covers the covering portion 81 to demarcate a channel 91 for receiving the free end 85 of the fastening portion 80. The cover 90 extends from the connection up to the vicinity of the fastener, i.e., from the mechanism 84 up to the rivet 83.

In his way, the free end 85 is maintained right above the coveting portion 81, regardless of the adjustment of the length of the strap.

In all cases, the channel must be understood as being a longitudinal cavity open at its two ends.

Generally speaking, the invention is made from materials and according to implementation techniques known to a person having ordinary skill in the art.

The invention is not limited to the particular examples described hereinabove, and includes all of the technical equivalents that fall within the scope of the claims that follow.

In particular, other shapes could be provided for the transverse cross-section of the covers, such as a square or a rectangle.

In certain cases, a reinforcement of the covering portion and the cover could be provided to form a single/unitary piece.

One could also provide that the cover be cut into successive sections juxtaposed longitudinally. In this latter case, a small space can be provided between each section. The advantage is that the strap bends more easily.

Furthermore, a strap according to the invention, or a device provided with a strap, can be used in any other technical field in which the foot or the boot of the user is linked to a sports apparatus by means of a strap tightening system, in particular the ski, snowshoe, roller skate, or the like.

What is claimed is:

1. A device for retaining a boot on a sports apparatus, said device comprising:

at least one strap to retain the boot on the apparatus, the strap extending between a first fastener and a second fastener of the device, the strap including a covering portion for covering the boot, and one or two fastening portions, a connection connecting each said fastening portion to the covering portion, one free end of said fastening portion being above the covering portion, wherein a cover covers the covering portion to demarcate a channel for receiving and housing the free end of each fastening portion during use of the sports apparatus.

2. A retaining device according to claim 1, wherein:

said one or two fastening portions comprises first and second fastening portions;

the retaining device further comprises:

a first connection including a ratchet tightening mechanism fixed to the covering portion; and teeth configured on the first fastening portion; and a second connection including a screw screwed into the covering portion through a hole of the second fastening portion.

3. A retaining device according to claim 1, wherein:

the cover has the shape of a chute, with a bottom substantially parallel to the covering portion and lateral portions affixed fixed relative to the covering portion.

4. A retaining device according to claim 1, wherein:

the cover is affixed to the covering portion by stitching.

5. A retaining device according to claim 1, further comprising:

a base edged laterally with a first and second flange; and wherein the first and second fasteners are made by screws for the journal of the fastening portions on the flanges.

6. A retaining device according to claim 1, wherein:

the cover is made of a flexible material.

7. A retaining device according to claim 1, wherein:

the cover is made of a rigid material.

8. A retaining device according to claim 1, wherein:

all free ends of all fastening portions of said strap are housed in said cover during use of the sports apparatus to avoid any of said free ends from freely projecting from said cover.

9. A retaining device according to claim 1, wherein:

the connection between one of said one or two fastening portions and the covering portion comprises a ratchet tightening mechanism fixed to the covering portion, said one of said one or two fastening portions slidably received within the rachet tightening mechanism and having teeth for adjustably positioning said one of said one or two fastening portions with respect to the tightening mechanism between a lowermost position and an upper position; and the free end of each of the fastening portions is housed in said channel in said lowermost position of the tightening mechanism.

10. A retaining device according to claim 1, wherein:

the cover is elongated along a length of the strap.

11. A retaining device for retaining a boot on a sports apparatus, said device comprising:

at least one strap to retain the boot on the apparatus, the strap extending between a first fastener and a second fastener of the device, the strap including a covering portion for covering the boot, and a single fastening portion, a connection connecting said single fastening portion to the covering portion, one free end of said single fastening portion being above the covering portion, wherein a cover covers the covering portion to demarcate a channel for receiving and housing the free end of said single fastening portion; and wherein the connection includes a ratchet tightening mechanism fixed to the covering portion and teeth configured on the single fastening portion.

12. A retaining device according to claim 11, wherein:

the cover has the shape of a chute, with a bottom substantially parallel to the covering portion and lateral portions affixed fixed relative to the covering portion, said chute extending from the tightening mechanism to the fastener of the covering portion.

13. A retaining device according to claim 11, wherein:

the channel houses the free end of each said fastening portion during use of the sports apparatus.

14. A retaining device according to claim 11, further comprising:

a base adapted to be affixed to the sports apparatus and adapted to support the boot, the base including a first flange and a second flange on opposite sides of the base, the first fastener fastening the single fastening portion to the first flange and the second fastener directly fastening the covering portion to the second flange.

15. A retaining device according to claim 11, wherein:

the free end of said single fastening portion of the strap is housed in the cover during use of the sports apparatus to avoid the free end from freely projecting from the cover.

16. A device for retaining a boot on a sports apparatus, said device comprising:

a base adapted to be affixed to the sports apparatus and adapted to support the boot;

at least one strap to retain the boot on the apparatus, the strap extending between a first fastener and a second fastener of the device, the first and second fasteners securing the strap with respect to the base, the strap comprising:

a covering portion for covering the boot;

at least one fastening portion, said one fastening portion being connected to the covering portion by a connection and being connected with respect to the base by one of the first and second fasteners;

a respective free end of each of said at least one fastening portion positioned above the covering portion;

a cover covering the covering portion to demarcate a channel for receiving and housing the free end of each of said at least one fastening portion during use of the sports apparatus, the cover extending from said connection up to said one of the first and second fasteners.

17. A retaining device according to claim 16, wherein:

all free ends of all of the at least one fastening portion of the strap are housed in the cover during use of the sports apparatus to avoid any of the free ends from freely projecting from the cover.

18. A retaining device according to claim 16, wherein:

said connection between said one fastening portion and said covering portion comprises a ratchet tightening mechanism fixed to said covering portion, said one fastening portion being slidably received within said rachet tightening mechanism and having teeth for adjustably positioning said one fastening portion with respect to said tightening mechanism between a lowermost position and an upper position; and the free end said one fastening portion is housed in said channel in said lowermost position of said tightening mechanism.

19. A device for retaining a boot on a sports apparatus, said device comprising:

a base adapted to be affixed to the sports apparatus and adapted to support the boot;

at least one strap to retain the boot on the apparatus, the strap extending between a first fastener and a second fastener of the device, the first and second fasteners securing the strap with respect to the base, the strap comprising:

a covering portion for covering the boot;

two fastening portions, each of said two fastening portions being connected with respect to the base by a respective one of said first and second fasteners;

a first connection connecting a first of said two fastening portions to the covering portion, and a second connection connecting a second of said two fastening portions to the covering portion;

a free end of each of said two fastening portions positioned above the covering portion;

a cover covering the covering portion to demarcate a channel for receiving and housing the free end of a first of said two fastening portions and the free end of a second of said two fastening portions during use of the sports apparatus, the cover extending from the first connection to the second connection.

20. A retaining device according to claim 19, wherein:

all free ends of both of said two fastening portions of the strap are housed in the cover during use of the sports apparatus to avoid any of the free ends from freely projecting from the cover.

21. A retaining device according to claim 19, wherein:

said first connection comprises a ratchet tightening mechanism fixed to said covering portion, said first fastening portion being slidably received within said rachet tightening mechanism and having teeth for adjustably positioning said first fastening portion with respect to said tightening mechanism between a lowermost position and an upper position; and the free end said first fastening portion is housed in said channel in said lowermost position of said tightening mechanism.

* * * * *